US010544561B2

(12) United States Patent
Desai et al.

(10) Patent No.: US 10,544,561 B2
(45) Date of Patent: Jan. 28, 2020

(54) COLLECTOR ASSEMBLY

(71) Applicant: C.A. Hull Co., Inc., Walled Lake, MI (US)

(72) Inventors: Jay Desai, Oxford, MI (US); Gary Bischer, Ubly, MI (US); Randy Rossow, Midland, MI (US)

(73) Assignee: C.A. Hull Co., Inc., Oxford, MI (US)

( * ) Notice: Subject to any disclaimer, the term of this patent is extended or adjusted under 35 U.S.C. 154(b) by 0 days.

(21) Appl. No.: 15/831,348

(22) Filed: Dec. 4, 2017

(65) Prior Publication Data

US 2019/0169816 A1 Jun. 6, 2019

(51) Int. Cl.
*E02F 3/40* (2006.01)
*E02F 5/02* (2006.01)

(52) U.S. Cl.
CPC ..... *E02F 3/401* (2013.01); *E02F 5/025* (2013.01)

(58) Field of Classification Search
CPC .. E02F 3/401; E02F 5/025; E01H 8/02; E01H 8/10
See application file for complete search history.

(56) References Cited

U.S. PATENT DOCUMENTS 750,852 A * 2/1904 Hart ..... E01H 8/105 15/354
2,584,675 A * 2/1952 Dangerfield ..... E01B 27/025 104/279
2,835,397 A 5/1958 Wagner
3,160,299 A 12/1964 Hartke
3,305,952 A * 2/1967 Dressler ..... E01H 8/00 104/279
3,349,717 A * 10/1967 Blix, Jr. ..... E01B 29/10 104/9
3,468,042 A * 9/1969 Coy ..... E01B 27/025 15/54
3,491,467 A * 1/1970 Finger ..... E01B 27/025 104/279
3,517,846 A 6/1970 King
3,571,838 A * 3/1971 Staschke ..... A47L 13/02 15/236.09
3,624,936 A * 12/1971 Yard ..... E01B 27/025 104/279
3,651,587 A * 3/1972 Plasser ..... E01B 27/025 172/735
3,782,573 A 1/1974 Garwood
4,047,486 A * 9/1977 Pabsdorff ..... E01B 27/04 104/9
4,184,522 A 1/1980 Waite
4,235,029 A * 11/1980 Ulm ..... E01B 27/025 104/279

(Continued)

FOREIGN PATENT DOCUMENTS

GB 547746 A 9/1942

*Primary Examiner* — Jamie L McGowan
(74) *Attorney, Agent, or Firm* — John S. Artz; Dickinson Wright PLLC

(57) ABSTRACT

A collector assembly for collecting debris from opposite sides of a member such as an elevated beam. The collector assembly includes a platform extending laterally between a first side edge and a second side edge. A first trough is provided for disposition along one side of the beam for receiving debris. A second trough is provided for disposition along the opposite side of the beam and is adjacent to and parallel with the first trough.

20 Claims, 4 Drawing Sheets

(56) References Cited

U.S. PATENT DOCUMENTS 4,263,851 A * 4/1981 Theurer ..... E01B 27/105 104/2
4,266,352 A * 5/1981 Newman ..... E01B 27/025 37/105
4,282,663 A * 8/1981 Theurer ..... E01B 27/025 37/104
4,298,224 A * 11/1981 Hansen ..... E04D 13/0765 15/236.04
4,633,601 A 1/1987 Fleck et al.
4,845,867 A 7/1989 Albrecht
4,848,818 A * 7/1989 Smith ..... E04D 13/0765 294/181
5,052,133 A * 10/1991 Mohr ..... E01B 27/026 104/279
5,114,299 A 5/1992 Roche et al.
5,251,389 A 10/1993 Bessey
5,273,375 A * 12/1993 Plourde ..... E01C 19/15 37/403
5,533,856 A 7/1996 Friesen et al.
5,564,886 A 10/1996 Emerson et al.
5,687,781 A 11/1997 Grizz
5,799,360 A * 9/1998 Vosbikian ..... A47L 13/52 15/159.1
6,085,447 A * 7/2000 Rose ..... E02F 3/962 37/403
6,126,216 A 10/2000 Tollefson
6,146,081 A 11/2000 Anderson
6,523,619 B1 * 2/2003 Cherry ..... A01B 31/00 172/684.5
6,526,619 B1 * 3/2003 Cassels, Jr. ..... E04D 13/0765 15/144.1
6,928,758 B1 * 8/2005 Stout ..... E02F 3/402 37/403
7,004,713 B2 2/2006 Sweningson
7,429,158 B2 * 9/2008 McFarland ..... E02F 3/401 37/274
7,647,713 B2 1/2010 Malacrino
8,096,066 B2 1/2012 Gandolfi
8,393,848 B1 3/2013 Krizenawski
8,887,413 B2 11/2014 Miller
8,955,238 B1 2/2015 Castruccio
8,955,892 B1 2/2015 Shumate
8,967,286 B2 3/2015 Kois
9,015,970 B1 4/2015 Doucette
9,631,332 B2 * 4/2017 Shubs, Jr. ..... E01H 8/04
10,094,084 B2 * 10/2018 Weiss ..... E01H 5/066
2003/0051305 A1 * 3/2003 Hewlett ..... E04D 13/0765 15/236.04
2003/0213086 A1 * 11/2003 Heavner ..... E04D 13/0765 15/236.04
2004/0253088 A1 12/2004 Sweningson
2006/0230648 A1 10/2006 Malacrino
2009/0293323 A1 12/2009 Van Camp
2010/0199527 A1 8/2010 Gandolfi
2010/0290887 A1 11/2010 Beale
2011/0005636 A1 1/2011 Hartley
2011/0216989 A1 9/2011 Hartley
2011/0262260 A1 * 10/2011 Lee ..... A01B 1/022 414/800
2013/0078070 A1 3/2013 May
2013/0298429 A1 11/2013 Niemela et al.
2014/0070556 A1 3/2014 Price
2015/0101218 A1 4/2015 Serrurier et al.
2015/0110592 A1 4/2015 Voelz et al.

* cited by examiner

COLLECTOR ASSEMBLY

TECHNICAL FIELD

A collector assembly. More particularly, a collector assembly for attachment to a construction machine for collecting broken debris from opposite sides of a member.

BACKGROUND OF THE DISCLOSURE

Collector assemblies are known in the art for connecting to construction machines, such as cranes or bulldozers, for moving and collecting debris. One such collector assembly is disclosed in U.S. Pat. No. 7,429,158, published on Sep. 30, 2008 to David L. McFarland. The collector assembly includes a center bucket and a pair of extensions that are slideably connected to opposing sides of the center bucket for expanding an operational width of the center bucket. Although such conventional collector assemblies are useful for moving debris after it has fallen to a ground, an issue is that they are not suitable for collecting debris during construction and demolition operations that take place on elevated work surfaces, such as during refinishing or demolition of a bridge. Accordingly, there are often safety and public access concerns during such operations because a large region beneath and around the elevated work surface has to be kept clear from the public. Accordingly, there remains a need for improvements to collector assemblies.

SUMMARY OF THE DISCLOSURE

It is an aspect of the present disclosure to provide a debris collecting assembly that is configured to efficiently collect debris during a construction or demolition operation on an elevated work surface.

It is another aspect of the present disclosure to provide a debris collecting assembly that is configured to collect debris during the removal of the debris from an elevated member such as a beam.

It is another aspect of the present disclosure to provide a debris collecting assembly that is simple in design and inexpensive to manufacture.

In accordance with the above and other aspects of the disclosure, a collector assembly is provided for collecting debris from opposite sides of a member. The collector assembly includes a platform extending laterally between a first side edge and a second side edge. A first trough is provided for disposition along one side of the member for receiving debris. A second trough is provided for disposition along the opposite side of the member and is adjacent to and parallel with the first trough.

According to the above and other aspects of the disclosure, the troughs of the collector assembly may be positioned on opposite sides of, and below a member for collecting debris that has fallen from the member or surrounding objects. The troughs eliminate the risk of debris falling from either side of the member while the debris is being removed from the member. Once the debris is collected, the collector assembly can be lifted and rotated using a crane so as to remove the debris from the troughs into waste containers for removal from a work site.

BRIEF DESCRIPTION OF THE DRAWINGS

Other aspects of the present disclosure will become better understood by reference to the following description when considered in connection with the accompanying drawings wherein.

DESCRIPTION OF THE ENABLING EMBODIMENT

Figure 1:
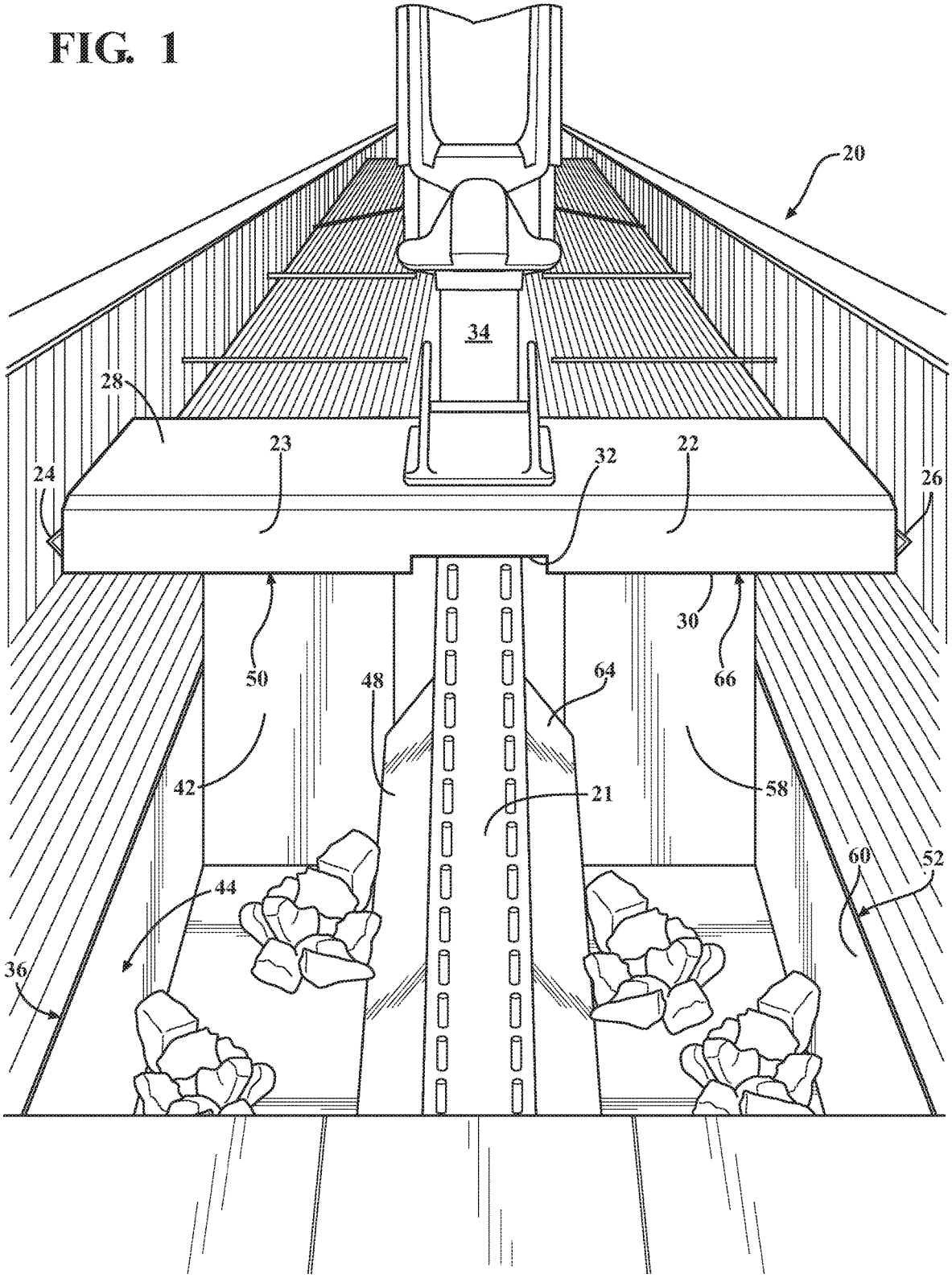
FIG. 1 is a perspective view of a collector assembly according to an aspect of the disclosure, illustrating the collector assembly in a lowered positioned in which first and second troughs are positioned on opposite sides of, and below a member for collecting debris that falls from a member during an operation.

Detailed aspects of the present disclosure are provided herein; however, it is to be understood that the disclosed aspects are merely exemplary and may be embodied in various and alternative forms. It is not intended that these aspects illustrate and describe all possible forms of the disclosure. Rather, the words used in the specification are words of description rather than limitation, and it is understood that various changes may be made without departing from the spirit and scope of the disclosure. As those of ordinary skill in the art will understand, various features of the present disclosure as illustrated and described with reference to any of the Figures may be combined with features illustrated in one or more other Figures to produce examples of the present disclosure that are not explicitly illustrated or described. The combinations of features illustrated provide representative examples for typical applications. However, various combinations and modifications of the features consistent with the teachings of the present disclosure may be desired for particular applications or implementations. Additionally, the features and various implementing embodiments may be combined to form further examples of the disclosure.

Referring to the Figures, wherein like numerals indicate corresponding parts throughout the several views, a collector assembly 20 is generally shown for attaching to a construction machine, such as crane. The collector assembly 20 is used to collect broken debris from opposite sides of, and below an elevated member 21 during a construction or demolition operation in which materials are removed from the member 21. In the example embodiment, the member 21 is presented as a beam 21 of a bridge which is being refinished, however it should be appreciated that the subject collector assembly 20 could be used during other types of operations and with other types of members.

The assembly 20 includes a platform 22, which may have a generally rectangular shape that extends laterally between a first side edge 24 and a second side edge 26. The platform 22 includes an upper surface 28 and a lower surface 30 facing opposite directions. The platform 22 may also include a front wall 23 and a rear wall 25 that extend between the first and second side edges 24, 26 in generally parallel relationship with one another. The front and rear faces 23, 25 may define a cut out 32, spaced equidistantly between the side edges 24, 26, for disposition over the member 21.

A connector 34 is attached to the upper surface 28 of the platform 22 for connecting the collector assembly 20 to the crane. The connector may be attached to the platform 22 in various ways including, but not limited to, welding, molding and fastening. The connector 34 extends transversely and upwardly from the upper surface 28 of the platform 22 and may be attached equidistantly between the side edges 24, 26.

The collector assembly 20 further includes a first trough 36 used for receiving broken debris. The first trough 36 may have a generally rectangular shape. The first trough has a first bottom 38. A first front end 40 may be attached to the first bottom 38, as by welding, molding, fastening, or any other method of attachment, and extends transversely from the first bottom 38. A first rear end 42 may be spaced from the first front end 40 and attached to the first bottom 38, as by welding molding, fastening, or any other method of attachment, and may extend perpendicularly from the first bottom 38. A first exterior side 44 may be attached to the first bottom 38, as by welding, molding, fastening, or any other method of attachment, and may extend perpendicularly from the first bottom 38. The first exterior side 44 may extend between the first front end 40 and the first rear end 42. A first interior side 46 may be spaced from the first exterior side 44 and attached to the first bottom 38, as by welding, molding, fastening, or any other method of attachment. The first interior side 46 may extend perpendicularly from the first bottom 38 and also between the first front end 40 and the first rear end 42.

A first deflector 48 may be attached to the first interior side 46, as by welding, molding, fastening, or any other method of attachment. The first deflector 48 may extend angularly from the first interior side 46 and may extend along the first trough 36. The first deflector 48 may be used for deflecting broken concrete debris into the first trough 36. It should be appreciated that the first deflector 48 may extend from the first interior side 46 at various angles. The first deflector 48 may also be configured such that its angular position relative to the first interior side 46 may be adjusted. It should also be appreciated that the first deflector 48 may be configured such that it is linearly extendable relative to the first interior side 46 to various lengths. Angular and linear movement of the first deflector 48 may be provided by various actuating mechanisms including, but not limited to, a hydraulic cylinder or electric motor.

A first slide mechanism 50 is disposed on the first rear end 42. The first slide mechanism 50 attaches the first trough 36, in a cantilevered fashion, to the lower surface 30 of the platform 22. The first slide mechanism 50 facilitates lateral movement of the first trough 36 across the lower surface 30 of the platform 22 between the cut out 32 and the first side edge 24. The first slide mechanism 50 includes a first actuator 51 for providing the lateral movement of the first tough 36. The first actuator 51 may include various types of actuators including, but not limited to a hydraulic piston or electric motor. A controller 53 is electrically connected to the first actuator 51 for selectively activating the first actuator 51. The first slide mechanism 50 further includes a pair of first tracks 55 defined by the front and rear walls 23, 25. The first slide mechanism 50 also includes a pair of first sliding members 57 that each extend from the first trough 26 are received by one of the first tracks 55 for facilitating the lateral movement of the first trough 36 by guiding the first trough 36. It should be appreciated that other mechanisms may be utilized to facilitate lateral movement of the first trough 36.

The collector assembly 20 further includes a second trough 52 used for receiving broken debris. The second trough 52 may be generally rectangular shaped. The second trough 52 includes a second bottom 54. A second front end 56 may be attached to the second bottom 54, as by welding, molding, fastening, or any other method of attachment, and extends transversely from the second bottom 54. A second rear end 58 may be spaced from the second front end 56 and attached to the second bottom 54, as by welding, molding, fastening, or any other method of attachment, and may extend perpendicularly from the second bottom 54. A second exterior side 60 may be attached to the second bottom 54, as by welding, molding, fastening, or any other method of attachment, and extends perpendicularly from the second bottom 54 and between the second front end 56 and the second rear end 58. A second interior side 62 may be spaced from the second exterior side 60 and attached to the second bottom 54, as by welding, molding, fastening, or any other method of attachment, and extends perpendicularly from the second bottom 54 and between the second front end 56 and the second rear end 58. The second trough 52 may extend adjacent to and parallel with the first trough 36.

A second deflector 64 may be attached to, as by welding, molding, fastening, or any other method of attachment, and may extend angularly from the second interior side 62 and extend along the second trough 52. The second deflector 64 may be used for deflecting broken concrete debris into the first trough 36. It should be appreciated that the second deflector 64 may extend from the second interior side 62 at various angles. The second deflector 64 may also be configured such that its angular position relative to the second interior side 62 may be adjusted. It should also be appreciated that the second deflector 64 may be configured such that it is extendable relative to the second interior side 62 to various lengths. Angular and linear movement of the second deflector 64 may be provided by various actuating mechanisms including, but not limited to, a hydraulic cylinder or electric motor.

A second slide mechanism 66 is disposed on the second rear end 58 and attaches the second trough 52, in a cantilevered fashion, to the lower surface 30. The second slide mechanism 66 facilitates lateral movement of the second trough 52 across the lower surface 30 of the platform 22 between the cut out 32 and the second side edge 26. The second slide mechanism 66 includes a second actuator 67 for providing the lateral movement of the second tough 52 toward and away from the first trough 36. The second actuator 67 may include various types of actuators including, but not limited to a hydraulic piston or electric motor. The second actuator 67 is electrically connected to the controller 53 for selectively activating the second actuator 67. The second slide mechanism 66 further includes a pair of second tracks 69 defined by the front and rear walls 23, 25 adjacent to the second side edge 26. The second slide mechanism 66 also includes a pair of second sliding members 71 that each extend from the second trough 52 are received by one of the second tracks 69 for facilitating the lateral movement of the second trough 52. It should be appreciated that other mechanisms may be utilized to facilitate lateral movement of the second trough 52.

Figure 2:
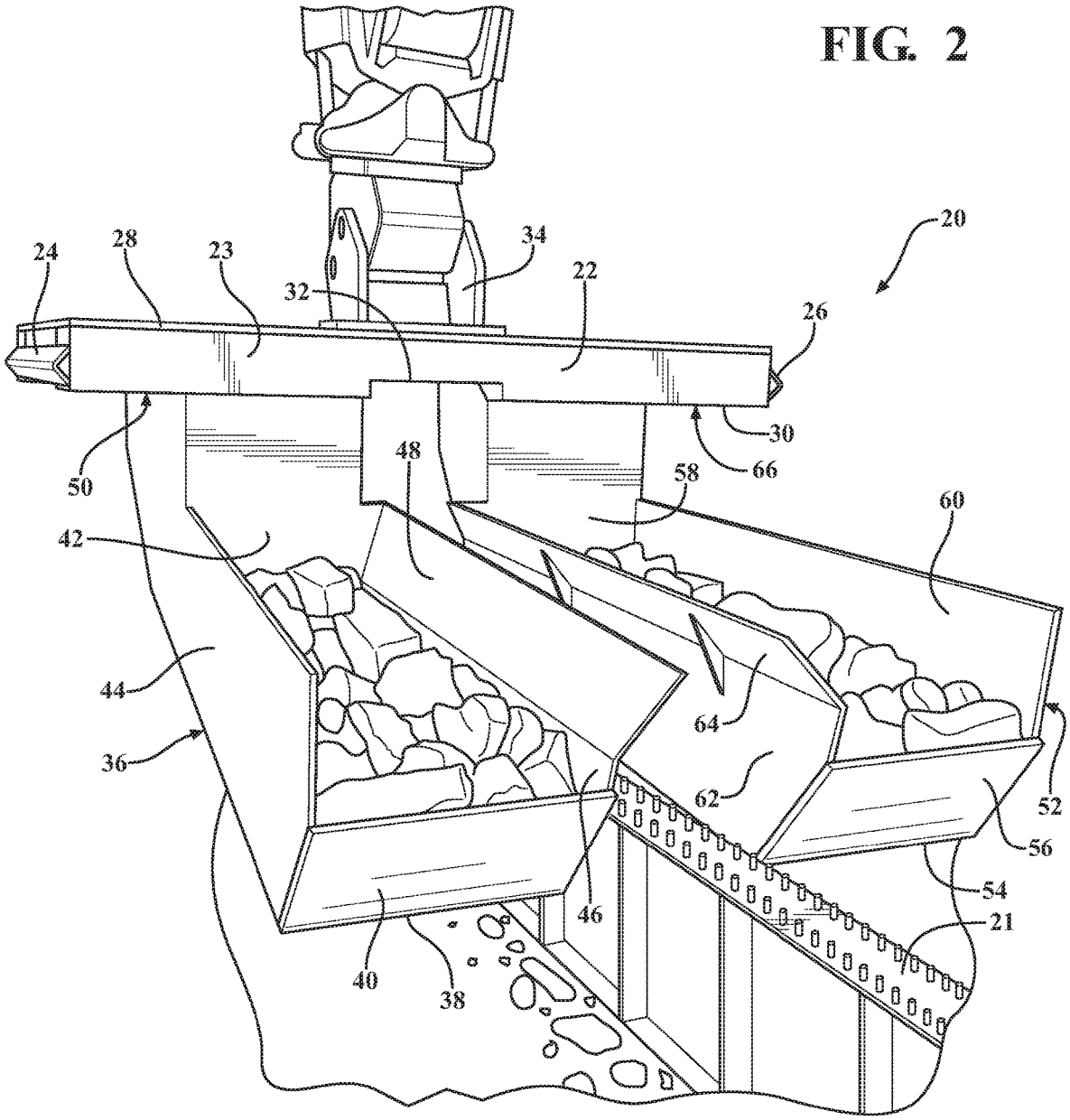
FIG. 2 is a perspective view of the collector assembly in a raised positioned above the member after it has collected debris.
Figure 3:
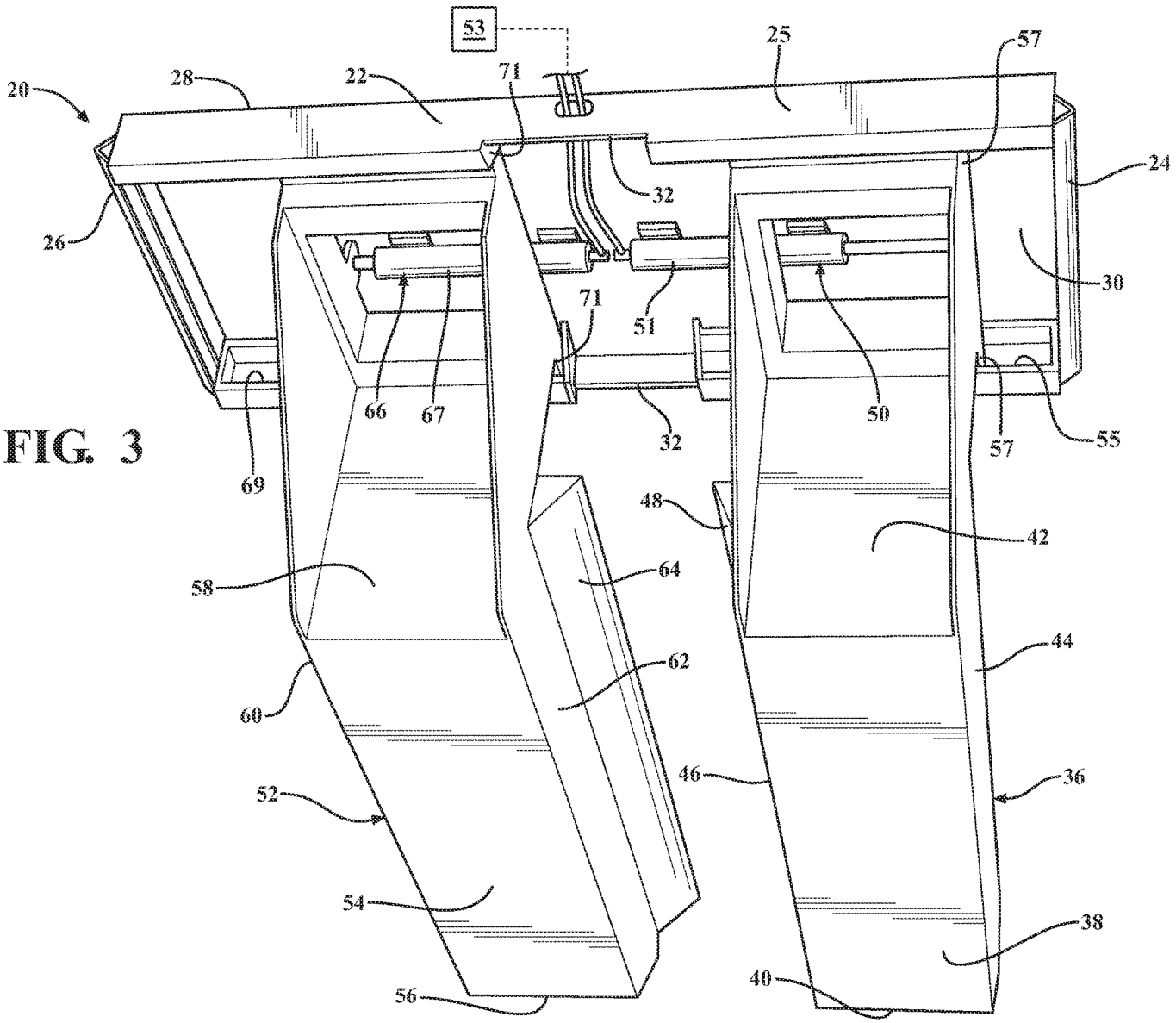
FIG. 3 is rear and underside view of the collector assembly.
Figure 4:
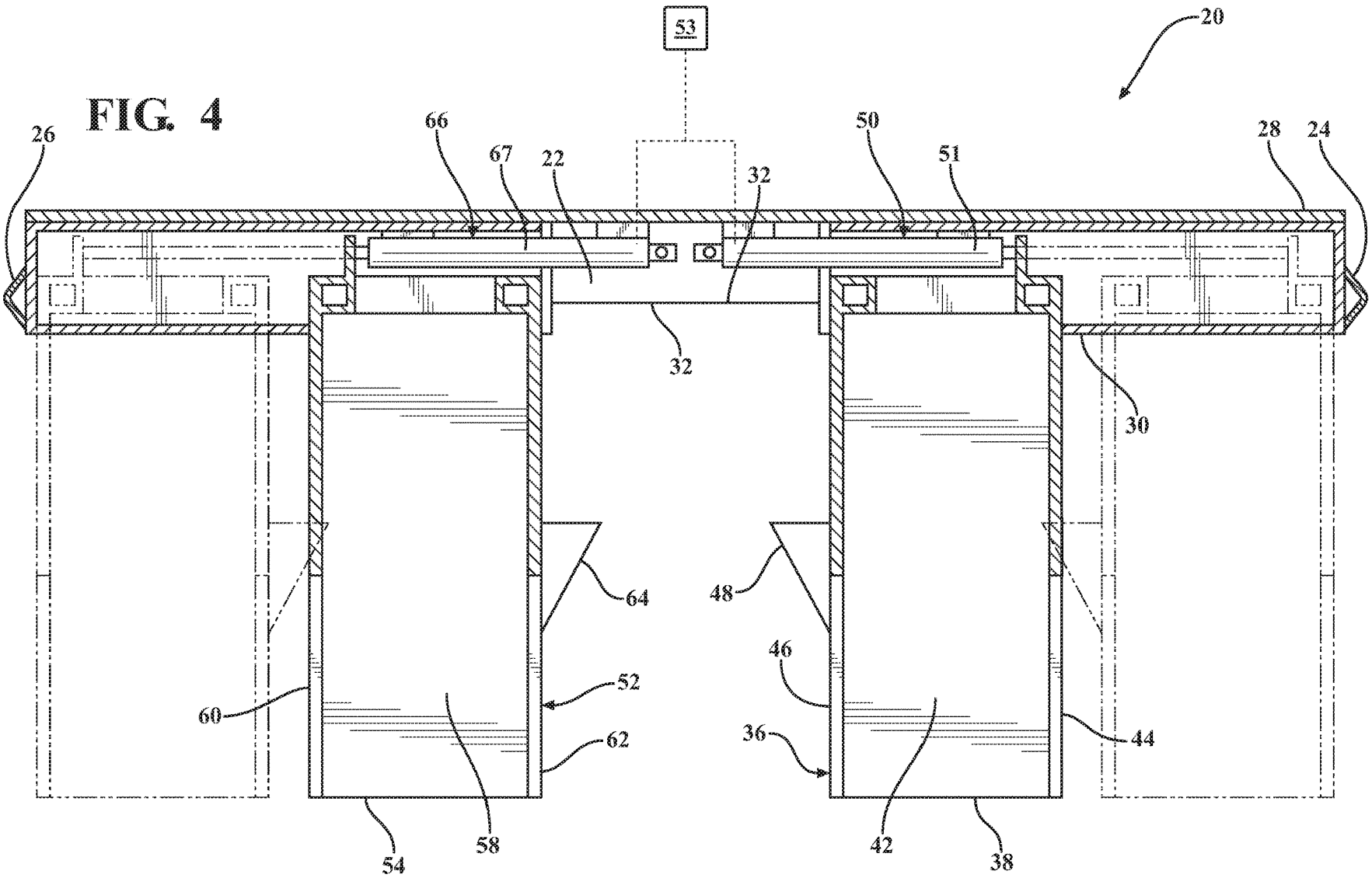
FIG. 4 is rear, cross-sectional view showing different, lateral positions of the troughs in the collector assembly.

During operation, the collector assembly 20 is attached to the end of the machine using the connector 34. The machine lowers the collector assembly 20 downwardly until the troughs 36, 52 are positioned on opposite sides of, and below the member 21 with the cut out 32 being aligned centrally with the member 21. The machine may lower the collector assembly 20 until the platform 22 comes into contact with or is positioned adjacent to the member 21. After the troughs 36, 52 are positioned on opposite sides of, and below the member 21, they may be moved toward one another until the deflectors 48, 64 come into contact with, or are positioned adjacent to the member 21, as best illustrated in FIG. 1. It should be appreciated that because the troughs 36, 52 are moveable toward and away from one another, the collector assembly 20 is configured to be positioned on opposite sides of members 21 of various various widths. Once the troughs 36, 52 are positioned near the member 21, the debris is removed from the member 21 and surrounding components from which it may fall into the troughs 36, 52, with the deflectors 48, 64 guiding and funneling the debris into the troughs 36, 52 to ensure no debris is lost between the member 21 and the troughs 36, 52. Upon completion of debris removal, the troughs 36, 52 are moved outwardly from the member 21 and each other and the machine may lift the collector assembly 20 above the member 21, as best illustrated in FIG. 2. The machine then transports the collector assembly 20 to a waste container where the collector assembly 20 is lifted and rotated until that the debris slides out of the troughs 36, 52 and into the waste container.

It should be appreciated that the simple construction of the collector assembly 20 makes it easy and inexpensive to manufacture. Furthermore, it should be appreciated that the simple arrangement of the collector assembly 20 allows it to be connected to various machines of different sizes.

The foregoing disclosure has been illustrated and described in accordance with the relevant legal standards, it is not intended that these examples illustrate and describe all possible forms of the present disclosure, thus the description is exemplary rather than limiting in nature. Variations and modifications to the disclosed examples may become apparent to those skilled in the art and fall within the scope of the present disclosure. Additionally, the features and various implementing examples may be combined to form further examples of the present disclosure.

What is claimed is:

1. A collector assembly to collect debris from the sides of a member, the assembly comprising:

a platform extending laterally between a first side edge and a second side edge;

a first trough coupled with the platform for disposition along one side of the member to receive broken debris;

a second trough coupled with the platform for disposition along the opposite side of the member adjacent to and parallel with the first trough to receive broken debris;

a first slide mechanism slideably connecting the first trough to the platform in cantilevered fashion and configured to laterally move the first trough toward and away from the second trough, and a second slide mechanism slideably connecting the second trough to the platform in cantilevered fashion and configured to laterally move the second trough to move toward and away from the first trough.

2. The collector assembly as set forth in claim 1 further including at least one actuator providing the sliding movement of the first trough relative to the platform, and providing the sliding movement of the second trough relative to the platform.

3. The collector assembly as set forth in claim 2 further including a controller electrically connected to the at least one actuator for selectively activating the at least one actuator.

4. The collector assembly as set forth in claim 1 wherein the platform has an upper surface and a lower surface opposite the upper surface, wherein the first trough is connected to the lower surface of the platform in a cantilevered fashion, and wherein the second trough is connected to the lower surface of the platform in a cantilevered fashion.

5. The collector assembly as set forth in claim 4 further including a connector attached to and extending transversely upwardly from the upper surface of the platform for connecting the platform to a crane.

6. The collector assembly as set forth in claim 4 wherein the first trough has a generally rectangular shape and has a first bottom, a first front end attached to and extending transversely from the first bottom, a first rear end spaced from the first front end and attached to and extending perpendicularly from the first bottom, a first exterior side attached to and extending perpendicularly from the first bottom and between the first front end and the first rear end, a first interior side spaced from the first exterior side and attached to and extending perpendicularly from the first bottom and between the first front end and the first rear end.

7. The collector assembly as set forth in claim 6 further including a first deflector attached to and extending angularly from and along the first trough for deflecting broken concrete debris into the first trough.

8. The collector assembly as set forth in claim 7 wherein the second trough has a generally rectangular shape and has a second bottom, a second front end attached to and extending transversely from the second bottom, a second rear end spaced from the second front end and attached to and extending perpendicularly from the second bottom, a second exterior side attached to and extending perpendicularly from the second bottom and between the second front end and the second rear end, a second interior side spaced from the second exterior side and attached to and extending perpendicularly from the second bottom and between the second front end and the second rear end.

9. The collector assembly as set forth in claim 8 further including a second deflector attached to and extending angularly from the second interior side along the second trough for deflecting broken concrete debris into the first trough.

10. The collector assembly as set forth in claim 9 further including the platform defining a cut out spaced equidistantly between the side edges for disposition over the beam.

11. A collector assembly to collect debris from the sides of a member, the assembly comprising:

a platform extending laterally between a first side edge and a second side edge;

a first trough for disposition along one side of the member to receive broken debris; and a first slide mechanism slideably connecting the first trough to the platform for providing sliding movement of the first trough relative to the platform, and a second slide mechanism slideably connecting the second trough to the platform for providing sliding movement of the second trough relative to the platform;

a second trough for disposition along the opposite side of the member adjacent to and parallel with the first trough to receive broken debris;

wherein the platform has an upper surface and a lower surface opposite the upper surface, wherein the first slide mechanism connects the first trough to the lower surface of the platform in a cantilevered fashion, and wherein the second slide mechanism connects the second trough to the lower surface of the platform in a cantilevered fashion.

12. The collector assembly as set forth in claim 11 wherein the first trough has a generally rectangular shape and has a first bottom, a first front end attached to and extending transversely from the first bottom, a first rear end spaced from the first front end and attached to and extending perpendicularly from the first bottom, a first exterior side attached to and extending perpendicularly from the first bottom and between the first front end and the first rear end, a first interior side spaced from the first exterior side and attached to and extending perpendicularly from the first bottom and between the first front end and the first rear end.

13. The collector assembly as set forth in claim 12 further including a first deflector attached to and extending angularly from and along the first trough for deflecting broken concrete debris into the first trough.

14. The collector assembly as set forth in claim 13 wherein the second trough has a generally rectangular shape and has a second bottom, a second front end attached to and extending transversely from the second bottom, a second rear end spaced from the second front end and attached to and extending perpendicularly from the second bottom, a second exterior side attached to and extending perpendicularly from the second bottom and between the second front end and the second rear end, a second interior side spaced from the second exterior side and attached to and extending perpendicularly from the second bottom and between the second front end and the second rear end.

15. The collector assembly as set forth in claim 14 further including a second deflector attached to and extending angularly from the second interior side along the second trough for deflecting broken concrete debris into the first trough.

16. The collector assembly as set forth in claim 15 further including the platform defining a cut out spaced equidistantly between the side edges for disposition over the beam.

17. The collector assembly as set forth in claim 11 further including a connector attached to and extending transversely upwardly from the upper surface of the platform for connecting the platform to a crane.

18. A collector assembly for attachment to an end of a crane to collect broken falling debris from the sides of an elevated beam, the assembly comprising:

a platform extending laterally between a first side edge and a second side edge;

the platform having an upper surface and a lower surface facing opposite directions;

a connector attached to and extending transversely upwardly from the upper surface of the platform for connecting the platform to the crane;

a first trough coupled with the lower surface of the beam for receiving broken debris;

a first slide mechanism slideably attaching the first trough to the lower surface of the platform for providing lateral movement of the first trough across the lower surface of the platform, a second trough coupled with the lower surface of the beam and extending in spaced and generally parallel relationship with the first trough for receiving broken debris; and a second slide mechanism slideably attaching the second trough to the lower surface of the platform for providing lateral movement of the second trough toward and away from the first trough.

19. The collector assembly as set forth in claim 18 wherein the first slide mechanism connects the first trough to the lower surface of the platform in cantilevered fashion and wherein the second slide mechanism connects the second trough to the lower surface of the platform in cantilevered fashion.

20. The collector assembly as set forth in claim 19 further including a first deflector attached to and extending angularly from and along the first trough for deflecting broken concrete debris into the first trough and a second deflector attached to and extending angularly from and along the second trough for deflecting broken concrete debris into the second trough.

* * * * *